US005718766A

United States Patent [19]

Vignot et al.

[11] Patent Number: 5,718,766

[45] Date of Patent: Feb. 17, 1998

[54] APPARATUS FOR GUIDING METAL STRIP IN A MOLTED METAL BATH

[75] Inventors: Jean Marie Vignot, Mairieux, France; Hubert Abels, Pommeroeul, Belgium

[73] Assignee: Vesuvius Crucible Company, Pittsburgh, Pa.

[21] Appl. No.: 918,494

[22] Filed: Jul. 22, 1992

[30] Foreign Application Priority Data

Jul. 26, 1991 [FR] France ..... 91 09/ 636

[51] Int. Cl.[6] ..... B05C 3/02

[52] U.S. Cl. ..... 118/423; 118/419; 492/16; 492/58

[58] Field of Search ..... 118/419, 424, 118/423, 428, 242; 492/53, 58, 59, 16; 427/434.2; 226/190, 196, 107; 148/242

[56] References Cited

U.S. PATENT DOCUMENTS

| | | | |
|---|---|---|---|
| 1,252,363 | 1/1918 | Roberts | 118/428 |
| 2,712,681 | 7/1955 | Warner | 226/190 |
| 2,735,156 | 2/1956 | Craver | 226/190 |
| 2,988,803 | 6/1961 | Mohn | 226/190 |
| 3,165,179 | 1/1965 | Shapland | 492/53 |
| 3,751,195 | 8/1973 | Snow | 432/148 |
| 4,190,017 | 2/1980 | Bizik et al. | 118/429 |
| 4,351,854 | 9/1982 | Pelerin . | |
| 4,412,503 | 11/1983 | Bakewell et al. | 118/428 |
| 4,509,453 | 4/1985 | Zaccheroni | 118/428 |
| 4,754,802 | 7/1988 | Yamauchi et al. | 164/428 |
| 4,967,663 | 11/1990 | Metcalf | 492/59 |
| 5,073,415 | 12/1991 | Taylor et al. | 118/423 |

FOREIGN PATENT DOCUMENTS

| | | |
|---|---|---|
| 0029629 | 11/1980 | European Pat. Off. . |
| 0051539 | 10/1981 | European Pat. Off. . |
| 0339338 | 4/1989 | European Pat. Off. . |
| 0346855 | 12/1989 | European Pat. Off. . |
| 7859906 | 7/1978 | Japan . |
| 7174440 | 10/1982 | Japan . |
| 8071325 | 4/1983 | Japan . |
| 8081918 | 5/1983 | Japan . |
| 0029457 | 2/1985 | Japan . |
| 61-37955 | 2/1986 | Japan . |

OTHER PUBLICATIONS

Search Report on corresponding French Appln 91 09 636 and references cited therein.

*Primary Examiner*—Brenda Adele Lamb

*Attorney, Agent, or Firm*—Webb Ziesenheim Bruening Logsdon Orkin & Hanson, P.C.

[57] ABSTRACT

A submerged guide member for guiding a strip of metal in a molten metal coating bath in the form of a roller or fixed guide consisting of sintered, fused or vitreous silica or a mixture of at least 80% by weight of fused or vitreous silica and up to 20% by weight of one or more members of the group consisting of refractory earth elements, metal oxides and compounds of oxides, carbides, borides, oxynitrides, SiAlON, thermal decomposition products of carbosilanes, calcia, magnesia, zircon ($ZrSiO_4$), zirconia, chromia and silicon carbide. The process concerns the deposition of a protective layer of, for example, zinc on a strip of sheet metal by submerging the metal strip in a bath of molten metal or metal alloy, and guiding the strip with one or more submerged rollers or fixed guide members of the fused silica material set forth above.

7 Claims, 2 Drawing Sheets

APPARATUS FOR GUIDING METAL STRIP IN A MOLTED METAL BATH

BACKGROUND OF THE INVENTION

The present invention relates to guide members such as fixed guides or rollers, solid, hollow, fixed, in free or driven rotation. The fixed guides or rollers are immersed in a bath of molten metal or metal alloys for the hot deposition of a corrosion resistant, protective layer on a submerged strip of sheet metal passing through the bath. The process is carried out by galvanization or by the deposition of a zinc, aluminum or tin alloy. The present invention also concerns a deposition process using these fixed guides or rollers or combinations thereof.

The deposition of a protective metal layer, for example, the deposition of zinc on a strip of sheet metal protects the underlying sheet metal against oxidation. This operation is carried out industrially by passing the sheet through a bath of molten metal or metal alloys to obtain a uniform thickness of deposited protective metal thereon.

According to a known technique, in order to guide the strip of sheet metal in the molten bath, the strip is placed in contact with rollers. These rollers are quite frequently made of metal, such as, for example, stainless steel, which gives rise to numerous shortcomings. In effect, the guide rollers operate in a highly aggressive medium, due notably to the elevated temperature of the bath, but primarily due to the corrosive reactions between the metals of the bath and the metal of the rollers.

Consequently, it is necessary to disassemble the rollers frequently, for example, at weekly intervals in order to descale and/or remachine the roller surfaces to remove the corroded layer formed on the roller. The rollers must then undergo finish-grinding to restore an acceptable surface finish and geometry. The commonly used metal rollers, thus, cause frequent shutdowns of the installation and high maintenance costs.

In order to remedy the above-noted disadvantages of metal rollers, it has been proposed to coat the roller surface with a protective layer. For example, the document EP 0 339 338 discloses cast iron rollers coated with a layer of carbon fibers enveloped in a carbon matrix. The document JP-A-61 37 955 (OSAKA FUJI KOGYO) discloses a metal roller coated with a ceramic layer deposited by plasma spraying.

Such coated rollers present numerous disadvantages. Adhesion problems between the ceramic coating layer and the metal roller appear rapidly due to the difference in thermal expansion between the metal roller and the ceramic surface layer. The force opposing the phenomenon of differential expansion is equivalent to the cohesion and bonding strength of the coating layer on the metal roller. This cohesion and bonding strength is not sufficient to prevent debonding of the coating layer. The end result of this thermal expansion mismatch is a rapid, localized or widespread disappearance of the protective coating layer, which causes the reappearance of corrosion problems and deterioration of the surface condition of the roller. These phenomena necessitate reapplying the coating of the rollers at short intervals, resulting in down time and high maintenance costs. These prior coated rollers, thus, have been noted for a reduced reliability and service life.

Rollers of fused silica for supporting strip or glass metal sheet in heat treatment furnaces are known, as disclosed, for example in U.S. Pat. No. 3,751,195. Such rollers, however, have never been used to the inventors' knowledge in a submerged molten metal environment.

SUMMARY OF THE INVENTION

The present invention provides a process for treating a strip of sheet metal and guide members for directing the strip through the bath of molten metal that remedy the above described shortcomings.

According to the process of the present invention, a strip of sheet metal is introduced into a bath of a molten metal or metal alloys to be deposited, in which the sheet is guided by at least one guide member. The guide member is produced from a base material comprising vitreous or fused silica. The strip of sheet metal is contacted by one or more such fused silica guide members to direct the path of movement of the strip of metal through the bath.

The use of a supporting surface of vitreous silica for contact with the metal sheet makes it possible to remedy the principal shortcomings of the prior coated or uncoated metal rollers. The effects of corrosion and oxidation are suppressed, as well as the problems of differential thermal expansion. Consequently, the useful service life of the guide member is greatly increased.

In addition, the surface condition of the fused silica guide member remains smooth over time so that the fixed guide or roller does not mark the moving sheet. This results in a coated metal strip product of improved surface quality.

The ceramic material employed in the guide member of the present invention preferably is at least 80% by weight vitreous or fused silica and may include up to 20% by weight of one or more members of the group consisting of: refractory earths or fire clays, metal oxides and compounds of oxides, carbides, borides, oxynitrides, SiAlON, as well as the thermal decomposition products of carbosilanes, CaO, MgO, $ZrSiO_4$, $ZrO_2$, $Cr_2O_3$ and SiC.

A further advantage provided by the invention resides in the fact that vitreous silica has a low wettability by the bath of molten metal.

Still further, the invention concerns a ceramic guide member particularly suited for use in the galvanization of a sheet metal strip.

According to one presently preferred embodiment of the invention, the guide member is in the form of a roller for immersion in a molten bath of metal. The roller may be used with or without roller bearings.

According to a second presently preferred embodiment of the invention, the guide member is a fixed guide immersed in the molten bath. This fixed guide has an advantage over rollers in the elimination of rotating bearings which must be immersed in molten metal and work under delicate conditions. Roller bearings are subject to the danger of failure, such as by seizing, and also subject to increased wear due to corrosion and erosion. The use of fixed guides thus provides an improvement in the reliability of operation over rollers with bearings.

Other objects, characteristics and advantages of the present invention will become more apparent upon reading the following detailed description, given solely for the sake of illustration, taken with reference to the attached drawings.

DETAILED DESCRIPTION OF THE INVENTION

Figure 1:
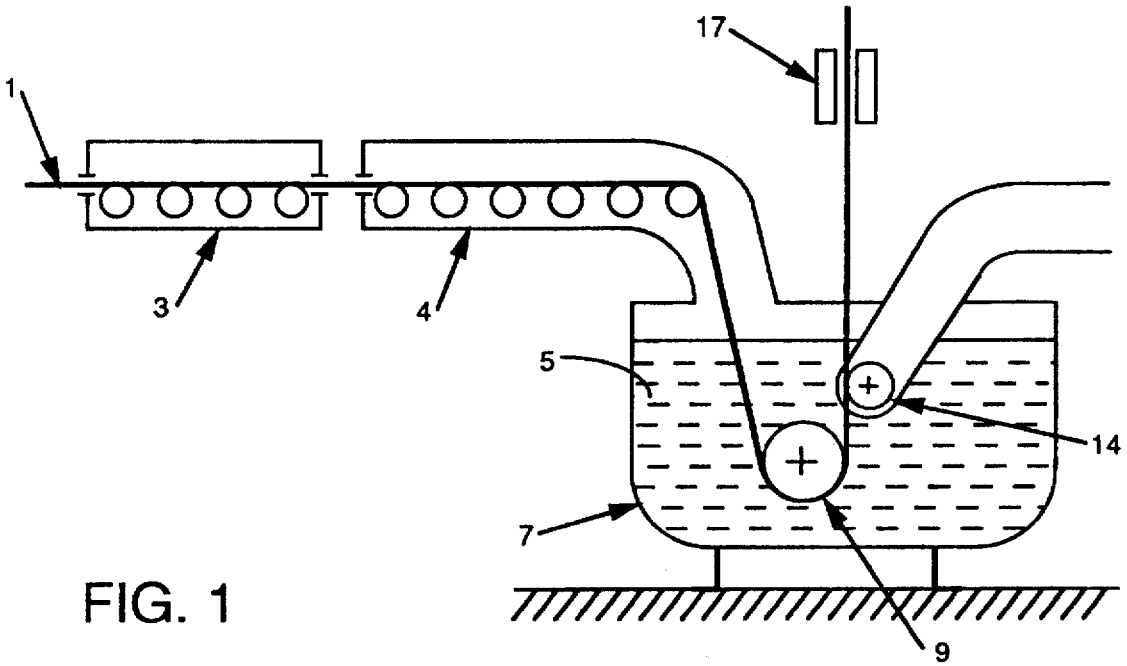
FIG. 1 is a schematic view of a galvanizing installation according to the invention.

The treatment installation shown in FIG. 1 makes it possible to galvanize a strip of sheet metal 1. This strip, unwound from a reel (not shown), passes first through a conventional preheating zone 3 in which the temperature is of the order of about 1150°–1300° C. The strip then moves to a conventional treatment (or annealing) zone 4 at a temperature of 900°–950° C. In the example described, the rate of travel of the metal strip 1 is about 140 m/min. The strip then passes through a conventional molten zinc bath 5 contained in a vat 7. The metal strip 1 is guided in the vat by a roller 9 of the present invention of relatively substantial diameter of about 8 feet (2.4 m) so as to minimize the radius of curvature of the strip. The strip 1 is then directed upwardly by a guide roller 14 of smaller diameter which is also made according to the present invention. Upon leaving the zinc bath, the zinc coated metal strip 1 passes through a conventional blowing zone 17 which cools the zinc coating, to solidify the molten deposit.

The submerged rollers 9 and 14, by necessity, operate in a very aggressive environment. The molten metal bath 5 is maintained at an elevated temperature which can range from 450° C. for a bath of pure zinc up to 600° C. for a bath of Galvalum (containing 50% zinc and 50% aluminum by weight).

The use of fused silica, also referred to as "vitreous" silica, for the rollers 9 and 14 offers important advantages over metal rollers, most notably, the absence of corrosion or scale pick up caused by the strip, or caused by the molten metal along with its excellent resistance to thermal shock, particularly during immersion of the roller in the zinc bath. In addition, fused or vitreous silica material is not wetted by the molten metal which provides a smooth guiding surface for the metal strip.

Figure 2:
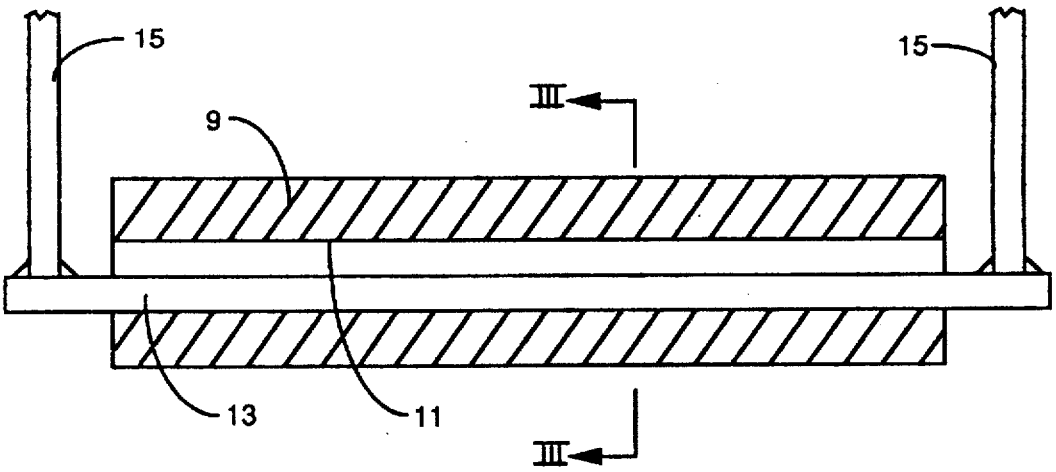
FIG. 2 is a cross sectional side view of a roller according to the invention, designed for an installation for galvanizing such as that of FIG. 1.
Figure 3:
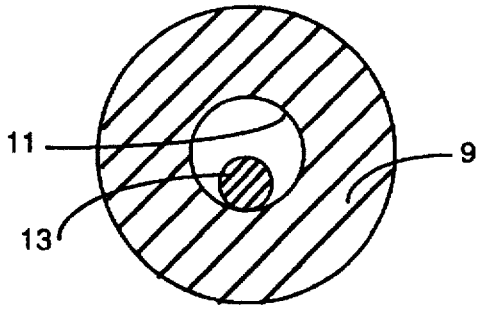
FIG. 3 is a cross sectional view of the roller taken along line III—III of FIG. 2.

FIGS. 2 and 3 respectively show a view in longitudinal section and a cross section of a roller according to the invention and comprising part of the treatment installation shown in FIG. 1. Roll body 9 comprises a slip cast and sintered, fused silica body. The cylindrically shaped roll body 9 is traversed by a longitudinal axial bore 11 and is adapted to be used without roller bearings. A stationary, mounting metal shaft 13 passes through the longitudinal bore 11 to permit the roller 9 to rotate directly against the mounting shaft 13. It will be noted that the roll body 9 of FIGS. 2 and 3 is not drawn to scale. By way of example, a typical roller 9 may have an outer diameter on the order of about 8 feet or 2.4 meters, an inner bore diameter of about 6 feet or 1.85 meters, and a length of about 9 feet or 2.8 meters. It is also noted that the diameter of the bore 11 is larger than the outside diameter of the metal shaft 13. The purpose of this arrangement is to permit the thermal expansion of the metal shaft 13. The shaft 13 is mounted on two arms 15 that serve to immerse the roller unit in the metal bath and prevent the longitudinal displacement of the roller 9. While the roller embodiment of FIGS. 2 and 3 has no roller bearings, it is, of course, understood that the fused silica roll body 9 can also be mounted on a suitable roller bearing hub and shaft arrangement, if desired, without departing from the invention.

Figure 4:
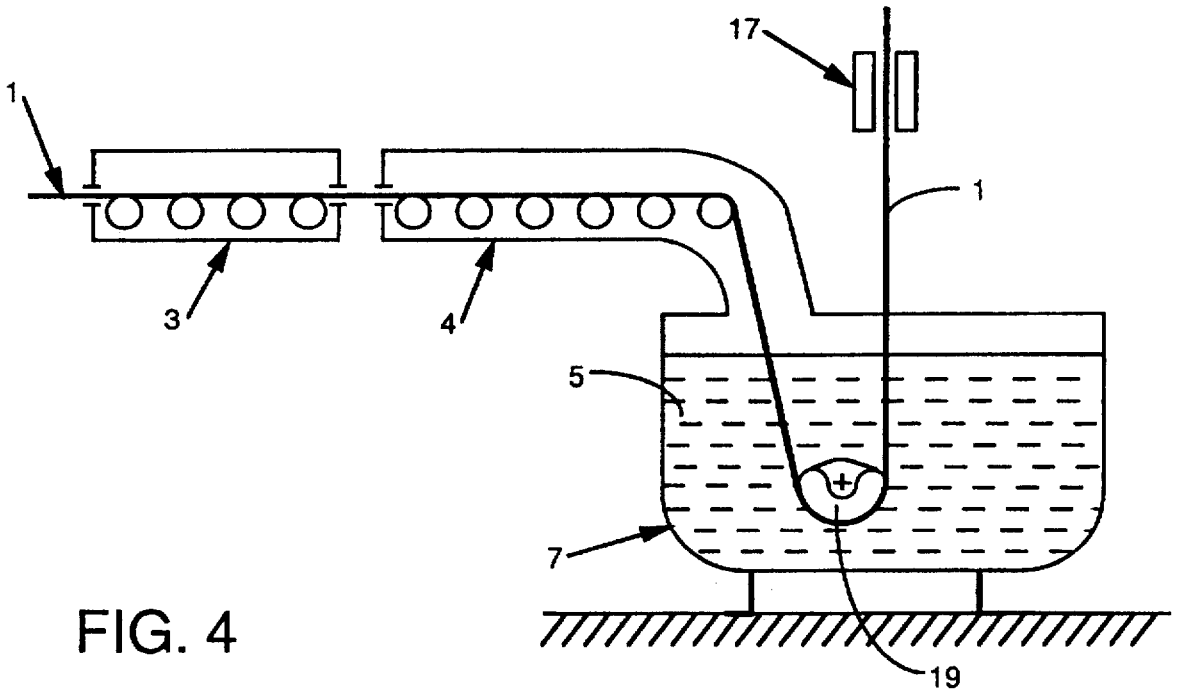
FIG. 4 shows a guide member of the invention consisting of a fixed guide.

FIG. 4 shows a further embodiment of the invention, in which the guide member is comprised of a fixed guide 19 made from fused silica material. In a manner similar to that described with reference to FIG. 1, the coating installation is comprised of a vat 7 containing a bath 5 of molten metal or metal alloys. The metal strip 1 passes through a preheating zone 3 and a heating zone 4 and then to the bath 5.

The difference between the embodiment of FIG. 4 and that shown in FIGS. 1 to 3 resides in the fact that the roller 9 is replaced with the fixed guide 19. Use of the fixed guide 19 avoids the necessity of having to use rotating bearings. The reliability of the installation employing a fixed guide is thus increased relative to a roller installation with roller bearings.

In order to make the roll body 9 or the fixed guide 19, a ceramic slip is prepared containing (on a dry basis) at least 80% by weight fused or vitreous silica and up to 20% by weight of one or more of: refractory earths or fire clay, metal oxides and compounds of such oxides, carbides, borides, oxynitrides, SiAlON, as well as the thermal decomposition products of carbosilanes, CaO, MgO, $ZrSiO_4$, $ZrO_2$, $Cr_2O_3$ and SiC. In a preferred composition, the ceramic material of the guide member contains 100% by weight fused silica.

The ceramic slip of the above-specified fused silica composition is then cast into a mold of the desired shape, such as a hollow or solid roll body 9 or a fixed guide 19. The mold may be made of plaster to remove the moisture from the cast slip. The molded shape is dried and then sintered at high temperature in a conventional manner to obtain a ceramic shape of high density.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed:

1. A guide roller assembly for guiding a strip of metal in a molten metal bath, wherein the improvement comprises:

a cylindrically shaped roll body having an axial bore therethrough, said roll body being made substantially in its entirety from a sintered refractory material comprising at least 80% by weight fused silica; and shaft means positioned in said axial bore for rotatably supporting said roll body while submerged in said molten metal bath.

2. A guide roller assembly of claim 1 wherein the shaft means comprises a stationary metal shaft having a diameter of a dimension less than a diameter of the axial bore of the roll body.

3. The guide roller assembly of claim 1 wherein the sintered refractory material contains substantially 100% by weight fused silica.

4. The guide roller assembly of claim 1 wherein the sintered refractory material contains up to 20% by weight of one or more members selected from the group consisting of refractory earth, metal oxides and compounds of metal oxides, carbides, borides and oxynitrides.

5. A fixed guide for guiding a strip of solid metal in a molten bath of metal, wherein the improvement comprises:

a shaped body having a guide surface for contacting a transverse surface of the metal strip for guiding the metal strip while said guide surface is submerged and in contact with the molten metal bath, said shaped body being made substantially in its entirety from a sintered refractory material comprising at least 80% by weight fused silica.

6. The fixed guide of claim 5 wherein the sintered refractory material contains substantially 100% by weight fused silica.

7. A fixed guide for guiding a strip of metal in a molten bath of metal, wherein the improvement comprises:

a shaped body having a guide surface for contacting and guiding the metal strip while said guide surface is submerged and in contact with the molten metal bath, said shaped body being made substantially in its entirety from a sintered refractory material comprising at least 80% by weight fused silica; and wherein the sintered refractory material contains up to 20% by weight of one or more members selected from the group consisting of refractory earths, metal oxides and compounds of metal oxides, carbides, borides and oxynitrides.

* * * * *

UNITED STATES PATENT AND TRADEMARK OFFICE

CERTIFICATE OF CORRECTION

PATENT NO. : 5,718,766

DATED : February 17, 1998

INVENTOR(S) : Jean Marie Vignot and Hubert Abels

It is certified that error appears in the above-identified patent and that said Letters Patent is hereby corrected as shown below:

Title Page, refer to [54] Title: "MOLTED" should read --MOLTEN--.

Column 1 Line 2, in the title, "MOLTED" should read --MOLTEN--.

Claim 4 Column 4 Line 57 "earth" should read --earths--.

Signed and Sealed this

Twenty-eighth Day of July, 1998

Bruce Lehman

*Attest:*

BRUCE LEHMAN

*Attesting Officer*

*Commissioner of Patents and Trademarks*